US005410285A

United States Patent [19]

Konishi

[11] Patent Number: 5,410,285

[45] Date of Patent: Apr. 25, 1995

[54] QUASI-TEM MODE DIELECTRIC FILTER

[75] Inventor: Yoshihiro Konishi, Sagamihara, Japan

[73] Assignee: Uniden Corporation, Ichikawa, Japan

[21] Appl. No.: 62,940

[22] Filed: May 18, 1993

[51] Int. Cl.[6] ..... H01P 1/205

[52] U.S. Cl. ..... 333/206; 333/222

[58] Field of Search ..... 333/202, 206, 207, 222, 333/203, 204, 219

[56] References Cited

FOREIGN PATENT DOCUMENTS 0467267 1/1992 European Pat. Off. ..... 333/202
0169802 7/1988 Japan ..... 333/202
0001310 1/1989 Japan ..... 333/202
0264501 10/1990 Japan ..... 333/202
0145804 6/1991 Japan ..... 333/206

*Primary Examiner*—Seungsook Ham
*Attorney, Agent, or Firm*—Stevens, Davis, Miller & Mosher

[57] ABSTRACT

In a dielectric material block surrounded by a metal film at least one air hole is provided. Inner faces of the at least one air hole are partly applied with at least one metal film. The at least one air hole is provided for providing coupled distributed lines, which are mutually coupled by electric fields passing partly through the at least one air hole, so as to realize a dielectric band pass filter, which has a small-sized structure and attains high precision and non-alignment of resonant frequency.

2 Claims, 13 Drawing Sheets

(Side Cross-Section)

(Bottom View)

(Even Mode Magnetic Field)

(Odd Mode Magnetic Field)

$a=8,\ b=4,\ c=4,\ d=2$ $S=1, 2, 3, 4$ $\varepsilon_0$ : Dielectric Constant of Air Hole $$\varepsilon = \varepsilon_r \cdot \varepsilon_0$$

$\varepsilon_r$ : Relative Dielectric Constant

QUASI-TEM MODE DIELECTRIC FILTER

BACKGROUND OF THE INVENTION

1. Field of the Invention

The present invention relates to a quasi-TEM dielectric filter, particularly, arranged for facilitating the attainment of a small-sized structure as well as attain non-alignment and high precision.

2. Related Art Statement

In general, a band pass filter (BPF) is formed, as shown in FIG. 1, of n resonators $D_1, D_2, \ldots, D_n$ and loads $R_1$ and $R_2$. In this drawing, $k_{i,\,i+l}$ indicates a coupling coefficient between resonators $D_i$ and $D_{i+l}$, while $Q_{el}$ and $Q_{en}$ indicate external Q's which are obtained from resonators $D_l$ and $D_n$ coupled with loads $R_1$ and $R_2$ respectively. The design of the band pass filter, which is formed as mentioned above, mainly concerned with the design of coupling coefficient $k_{i,\,i+l}$ and external Q's, $Q_{el}$ and $Q_{en}$.

In this connection, the coupling between resonators is mainly attained by the following methods.

(A) A method for coupling two resonators through a pure reactance element.

Two resonating circuits are usually coupled with each other capacitively as shown in FIGS. 2A and 2B or inductively as shown in FIGS. 2C and 2D, as follows.

(a) Coupling through a pure reactance element between resonators.

For instance, central conductors of λg/4 dielectric coaxial resonators are coupled with each other through a reactance element C or L, which is an externally adopted element or an adequate electrode deposited on a ceramic material of the dielectric resonator.

(b) Coupling through an adequate structure variation provided within a symmetry plane between resonators.

For instance, as shown in FIG. 3, a hole or a groove is formed between two resonators.

In an even mode operation, no electric field exists in the vicinity of the symmetry plan as shown in FIG. 4A, so that the operation is not affected by the hole or the groove, and hence the resonant angular frequency $\omega_{re}$ is not greatly varied. However, in an odd mode operation, an electric field perpendicular to the symmetry plane exists as shown in FIG. 4B, so that the energy of the electric field is reduced in the vicinity of the hole or the groove, and hence the odd mode resonant angular frequency $\omega_{ro}$ is raised. As a result, a coupling coefficient k expressed by the following equation (1) is obtained, $$k = 2\left|\frac{\omega_{ro} - \omega_{re}}{\omega_{ro} + \omega_{ro}}\right| \quad (1)$$

and hence an equivalent circuit as shown in FIG. 4C is obtained.

In this connection, when a metal film is applied inside the hole or the groove as shown in FIG. 3, the even mode resonant angular frequency $\omega_{re}$ is not varied, while the odd mode resonant angular frequency $\omega_{ro}$ is lowered, because, in the odd mode operation, the path of the electric field connecting two resonators is shortened and hence capacities of these resonators are increased. As a result, an equivalent circuit is attained by coupling two resonating circuits $C_iL_i$ and $C_jL_j$ through a capacity $C_{ij}$ as shown in FIG. 5.

The coupling elements, that is $L_{ij}$ in FIG. 4C and $C_{ij}$ in FIG. 5, can be calculated according to the perturbation theory, when these coupling elements are small-sized.

The above-mentioned coupling structure can be provided on the earthed (grounded) end face of the λg/4 resonator as well as on the open end face thereof.

For instance, as shown in FIGS. 6A and 6B, a shallow hole is provide in the central portion of the earthed bottom face of the λg/4 resonator, inside which a metal film is applied. In the even mode operation, no magnetic field exists in the central portion as shown in FIG. 6C, so that the operation is not affected by the hole. However, in the odd mode operation, conductors exist in the magnetic field of the most intensity, so that the resonant angular frequency is raised according to the perturbation theory.

That is, $$\omega_{re} = \omega_r$$

$$\omega_{ro} > \omega_r$$

As a result, the equivalent circuit as shown in FIG. 4(*c*) is obtained.

Furthermore, various variations of shape of the coupling element can be conceived so as to obtain the difference between even mode and odd mode resonant angular frequencies. As is apparent from the above description, the variation of shape of the coupling structure in the vicinity of the symmetry plane has a large effect.

(c) Coupling through a dielectric wave guide from a surrounding metal face of which a conductive portion in parallel with the cross-section is removed.

An example of this coupling structure is shown in FIG. 7A and an equivalent circuit thereof is shown in FIG. 7B. As is apparent from these drawings, the capacitive coupling can be attained in this structure.

(B) A method for coupling two resonators through a cut-off wave guide.

A general arrangement therefor is shown in FIG. 8A and an example in which $TE_{10}^{\square}$ (i.e., $TE_{10}$ rectangular mode) dielectric wave guides are coupled through a cut-off wave guide is shown in FIG. 8B, and further an equivalent circuit is shown in FIG. 8C.

Next, an example of a λg/4 multistage B.P.F. provided according to FIGS. 7A and 8B is shown in FIG. 9. In FIG. 9, the portion indicated by δ is operated as capacitive coupling, while the portion indicated by W is operated as inductive coupling.

On the other hand, as for a three stage B.P.F. which is formed of a combination of a λg/4 coaxial dielectric resonator and a λg/2 $TE_{10}^{\square}$ (i.e., $TE_{10}$ rectangular mode) dielectric wave guide, the structure and the property thereof are shown in FIGS. 10A and 10B, respectively. In this multistage B.P.F., the coaxial resonator and the wave-guide resonator are inductively coupled with each other through a cutoff wave guide.

In this connection, a dielectric resonator, for instance, of $TE_{10}^{\square}$ mode is arranged in series with a TE cutoff wave guide, so as to be inductively coupled with each other as frequency adopted.

The TE cutoff wave guide is employed for the inductive coupling as mentioned above, while the TM cutoff wave guide can be employed for the capacitive coupling.

(C) A method for coupling two resonators through coupled distributed lines.

Coupled distributed lines consist, for instance, of two symmetrical distributed lines, earthed end portions of which cross each other. When ends on mutually opposite sides of two symmetrical distributed lines having the length (l) are earthed and the other ends thereof are opened as shown in FIG. 11A, the equivalent circuit thereof becomes as shown in FIG. 11B. In this equivalent circuit, $Z_e$ and $Z_o$ denote characteristic impedances in the case that parallel two lines as shown in FIG. 11A are excited in even mode and in odd mode, respectively. In addition, when $l \simeq \lambda g/4$, the equivalent circuit as shown in FIG. 11C is obtained. In this equivalent circuit, L and C are expressed by the following equation (2)

$$\left.\begin{aligned} L &= \frac{\pi}{4\omega_r} Z_o \\ C &= \frac{4}{\pi\omega_r Z_o} \end{aligned}\right\} \quad (2)$$

Accordingly, FIG. 11C shows a circuit arrangement in which two series resonating circuits are coupled with each other through a $\lambda g/4$ line having characteristic impedance of $(Z_e - Z_o)/2$. In this circuit arrangement, when even mode and odd mode exciting angular frequencies are denoted by $\omega_{re}$ and $\omega_{ro}$ respectively, the following equation (3) is obtained.

$$\left.\begin{aligned} \omega_{re} &= \frac{1}{\sqrt{(L + L')C}} & \omega_{ro} &= \frac{1}{\sqrt{L \cdot \frac{CC'}{C + C'}}} \\ L' &= \frac{Z_e - Z_o}{2\omega_r} & C' &= \frac{Z}{\omega_r(Z_e - Z_o)} \end{aligned}\right\} \quad (3)$$

As is apparent from this equation (3), $$\omega_{ro} > \omega_{re} \quad (4)$$

Resonant angular frequencies $\omega_{ro}$, $\omega_{re}$ can be obtained by substituting the equation (2) for the equation (3), while the coupling coefficient k can be obtained from the equation (1).

For the simplification, in the case that $$Z_e - Z_o \quad Z_o$$

the relation L'' L, C' C are obtained.

Accordingly, $$\omega_{re} \simeq \omega_r\left(1 - \frac{L'}{2L}\right), \quad \omega_{ro} \simeq \omega_r\left(1 + \frac{C}{2C'}\right)$$

So that the coupling coefficient k is expressed by the following equation (5).

$$k \simeq \frac{2}{\pi} \frac{Z_e - Z_o}{Z_o} \quad (5)$$

It can be understood also that when the space between two conductors is increased, $Z_e$ and $Z_o$ approach the same value and k becomes smaller.

(D) A method for coupling two resonators through uniformly coupled lines provided within a so-called nonuniform medium containing more than two dielectric mediums having individually different dielectric constants or permeabilities.

In this case, phase constants respectively regarding different modes can be varied from each other. For instance, when an air hole is formed near the midpoint between the central conductors as shown in FIGS. 12A, B, C, the effective dielectric constant is not so varied in the even mode, while it becomes smaller in the odd mode. On the other hand, the inductance per unit length is not so varied by providing the air hole in case that the cross-section of the conductor is small in comparison with the wave length, so that, the phase constant in the odd mode becomes smaller ultimately and hence the resonant frequency is raised, and, as a result, these two resonators are coupled with each other.

In general, uniformly two coupled lines within the nonuniform medium consisting of more than two kinds of mediums as shown in FIG. 13A have two different intrinsic propagation constants $\beta_1$ and $\beta_2$, which are expressed by the following equation (6).

$$\beta_1 \neq \beta_2 \ldots \quad (6)$$

When, as shown in FIG. 13B, self-inductances per unit length of conductors 1 and 2 and mutual-inductance thereof are denoted by $L_1$, $L_2$ and M respectively, while self-capacities and mutual-capacity thereof are denoted by $C_{11}$, $C_{22}$ and $C_{12}$ respectively, the intrinsic propagation constants $\beta_1$, $\beta_2$ are expressed by the following equation (7).

$$\beta_{1,2} = \frac{\omega\sqrt{L_o C_o}}{\sqrt{2}}\left[n_l m_c + \frac{1}{n_l m_c} - 2k_l k_c \pm \sqrt{\left(\frac{1}{n_l m_c} - n_e n_c\right)^2 + 4\left(\frac{k_l}{n_c} - n_e k_c\right)\left(k_l m_c - \frac{k_c}{n_l}\right)}\right]^{\frac{1}{2}} \quad (7)$$

$$= \frac{\omega}{\sqrt{2}}\left[L_1C_1 + L_2C_2 - 2MC_{12} \pm \sqrt{(L_2C_2 - L_1C_1)^2 + 4(MC_2 - L_1C_{12})(MC_1 - L_2C_{12})}\right]^{\frac{1}{2}}$$

In this equation (7), $$\left.\begin{aligned} n_l &= \sqrt{\frac{L_1}{L_2}}, \; n_c = \sqrt{\frac{C_1}{C_2}}, \\ k_l &= \frac{M}{\sqrt{L_1L_2}}, \; k_c = \frac{C_{12}}{\sqrt{C_1C_2}} \\ L_o &= \sqrt{L_1L_2}, \; C_o = \sqrt{C_1C_2}, \\ C_1 &= C_{11} + C_{12}, \; C_2 = C_{22} + C_{12}, \end{aligned}\right\} \quad (8)$$

On the other hand, when the above mentioned structure has a symmetric cross-section as shown in FIG. 14, $$L_1=L_2, \; C_1=C_2$$

and hence $n_l=n_c=1$.

So that these relations are substituted for the equation (7) as follows.

$$\left.\begin{aligned} \beta_1 &= \omega\sqrt{L_oC_o(1 + k_l)(1 - k_c)} \\ \beta_2 &= \omega\sqrt{L_oC_o(1 - k_l)(1 + k_c)} \end{aligned}\right\} \quad (9)$$

These constants $\beta_1$ and $\beta_2$ correspond to the even mode and the odd mode respectively, and hence are denoted by $\beta_e$ and $\beta_o$ respectively.

That is, $$\beta_1=\beta_e, \; \beta_2=\beta_o \quad (10)$$

In case that only a single medium is used, namely, in a uniform medium, the following relation can be certified.

$$k_l=k_c=k \quad (11)$$

So that, the following condition is attained.

$$\beta_e=\beta_o \quad (12)$$

Consequently, the relation expressed by the equation (6) can be attained only in the case of the nonuniform medium.

When both ends of two coupled lines having a length l within the nonuniform medium are short-connected, these coupled lines resonate at two angular frequencies $\omega_1$ and $\omega_2$, which can be obtained as follows.

$$\beta_{1,2}l=m\pi \; 1, 2 \quad (13)$$

In the equation (7) or the equation (9) of the symmetric structure, the following condition is considered, so as to obtain these frequencies.

For instance, in the case of symmetric structure, the following equation (14) is obtained.

$$\left.\begin{aligned} \omega_1 &= \frac{m\pi}{l\sqrt{L_oC_o(1 + k_l)(1 - k_c)}} \\ \omega_2 &= \frac{m\pi}{l\sqrt{L_oC_o(1 - k_l)(1 + k_c)}} \end{aligned}\right\} \quad (14)$$

Accordingly, the relations $\omega_1=\omega_e$ and $\omega_2=\omega_o$ are substituted for the equation (1), so as to obtain the coupling coefficient k.

However, in the above-described conventional quasi-TEM mode dielectric filters, large-scaled structures formed of many constituents and difficult design and troublesome alignment caused by the complicated structures cannot be avoided as serious defects.

SUMMARY OF THE INVENTION

An object of the present invention is to provide a quasi-TEM mode dielectric filter in which small-sized structure is obtained and the non-alignment and the high precision are attained.

A quasi-TEM mode dielectric filter according to the present invention is featured in that at least one of the resonators provided individually with uniform quasi-TEM mode lines which are formed of holes, which penetrate through a dielectric material block surrounded by a conductor film in parallel with the surrounding conductor film. Inside each of the holes a conductor film is applied except on a part of a cross-section of the hole. Further, at least a part of an electromagnetic field coupling between the conductor films applied inside the holes passes through each of the holes.

BRIEF DESCRIPTION OF THE DRAWINGS

For the better understanding of the invention, reference is made to the accompanying drawings, in which.

DESCRIPTION OF THE PREFERRED EMBODIMENTS

Preferred embodiments of the present invention will be described in detail by referring to accompanying drawings hereinafter.

Figure 15A:
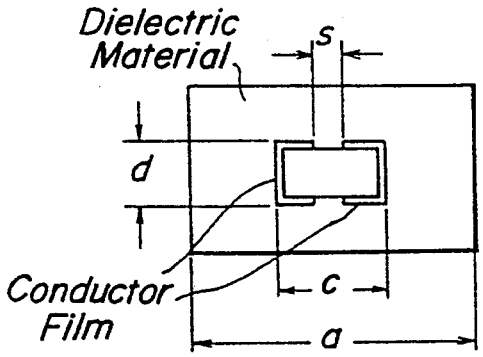
FIGS. 15A and 15B are cross-sectional views showing examples of coupling structures according to the present invention respectively.
Figure 15B:
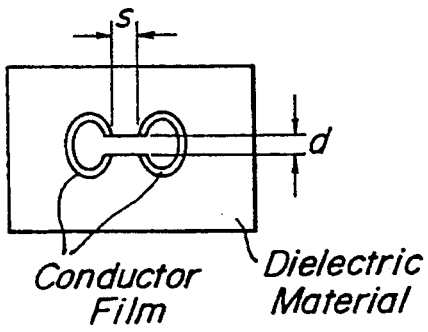

A quasi-TEM mode dielectric filter according to the present invention is featured by a simplified and small-sized structure which is attained by employing uniformly coupled distributed lines provided within nonuniform mediums consisting of more than two different mediums, an example of which is shown in FIGS. 15A and 15B.

In a structure as shown in these drawings, a dielectric ceramic block is surround by a metal film, a hole being provide at the center of the dielectric ceramic block and two metal films being symmetrically applied on an inner wall of the hole, so as to attain the difference of phase constant between the even mode and the odd mode in thus arranged dielectric ceramic block. In other words, an electric field does not substantially exist in the hole in the even mode, while the electric field passes through the hole in the odd mode. So that, the capacity per unit length of the thus formed line is reduced by the existence of the hole only in the odd mode, while the inductance per unit length thereof is not substantially varied by the existence of the hole, because the size of the hole is smaller than the wave length.

Conclusively speaking, the resonant frequency in the odd mode is raised by the existence of the hole and, as a result, coupling through the hole is caused and the degree of thus coupling can be varied in response to the sizes d and s as shown in FIG. 15.

Figure 16:
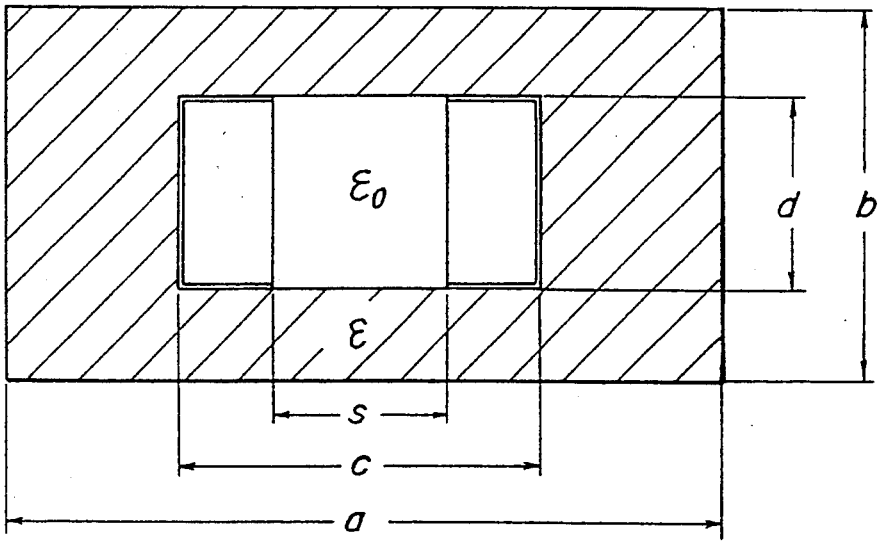
FIG. 16 is a cross-sectional view showing a numerical example of a coupling structure according to the present invention.
Figure 17:
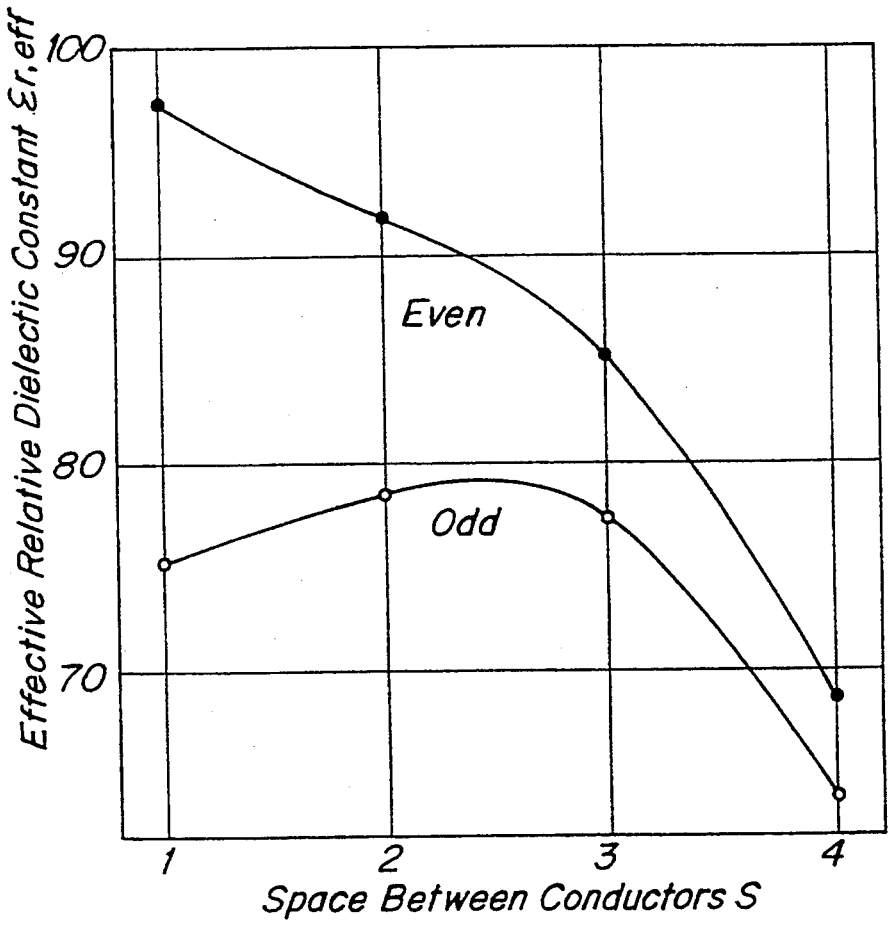
FIG. 17 is a characteristic curve showing an example of effective dielectric constant characteristic of the same.

For instance, in the structure as shown in FIG. 15A, the variation of effective relative dielectric constants $\epsilon_{r\text{-}eff}$ in response to the variation of sizes of the structure of coupled distributed lines as shown in FIG. 16 in the even mode and in the odd mode is obtained as shown in FIG. 17. On the other hand, the variation of phase velocity $V_e$ and $V_o$ in the even mode and in the odd mode is obtained on the basis of FIG. 17 as shown in FIG. 18.

Figure 18:
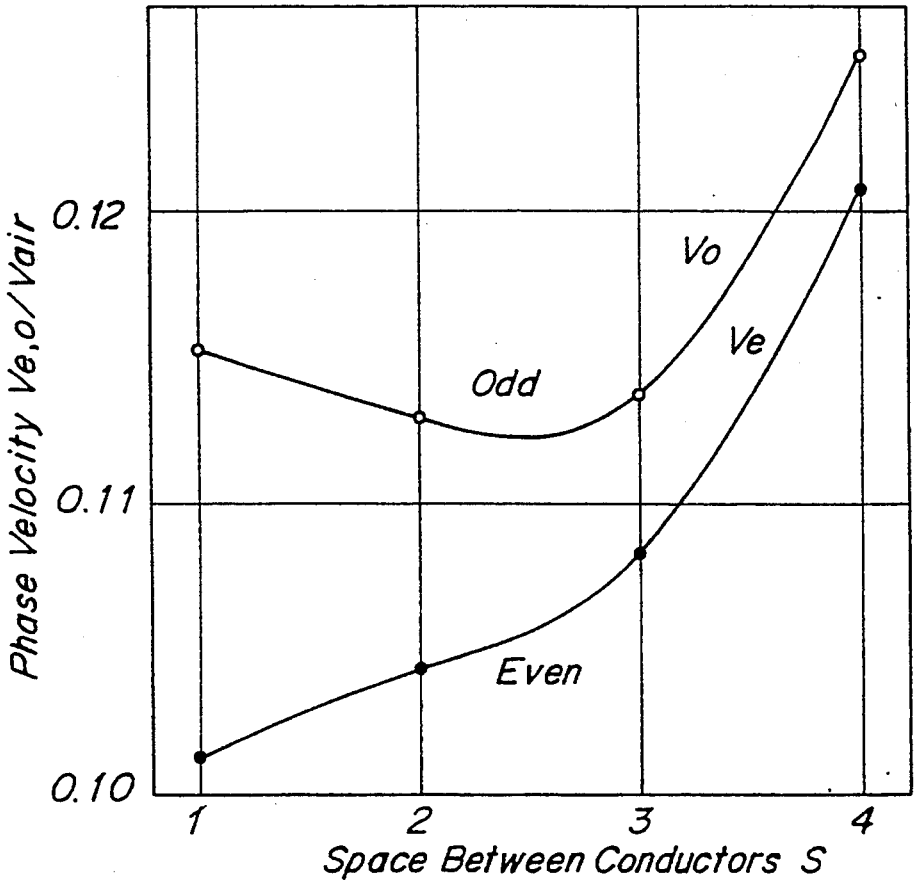
FIG. 18 is a characteristic curve showing an example of phase velocity characteristic of the same.

In this connection, $V_{air}$ in FIG. 18 denotes the phase velocity in free air space.

The following is apparent from the above description.

(i) The effective dielectric constant in the even mode is always larger than that in the odd mode. It is because the electric field substantially exists only in the dielectric ceramic block in the even mode, while it also exists in the air hole in the odd mode.

(ii) The wider the space S between conductor films inside the air hole is, the larger the effective dielectric constant $\epsilon_{r\text{-}eff}$ in the even mode is. It is because the component in the air hole of the electric field is increased.

(iii) In the odd mode, the effective dielectric constant $\epsilon_{r\text{-}eff}$ becomes the largest at an appropriate value of the air space S. It is caused as follows.

While the air space S is very small, the proportion of the capacity referred to an electric wall formed of the symmetry plane is large, and hence approaches to $\epsilon_{r\text{-}eff}/2$, that is, for instance, 50. However, when the air space S is increased, the proportion of the capacity between conductor lines and the surrounding conductor film is increased, and hence the effective dielectric constant $\epsilon_{r\text{-}eff}$ is increased so as to approach, for instance, to 100. In contrary, when the air space S is furthermore increased, the electric field in the air hole is increased, and hence the effective dielectric constant is reduced again.

In this connection, when the case that resonance is caused at the length l of the conductor lines being (2m+l) times of one half the wave length is considered, the following relation as for the phase velocity V is obtained.

$$\frac{V}{f} = 2l(2m+1) \tag{15}$$

So that, $$\omega_{e,o} = \frac{\pi V_{e,o}}{l(2m+1)}$$

That is, $$\frac{\omega_{e,o}}{\omega_{air}} = \frac{V_{e,o}}{V_{air}}$$

For instance, when the case that a two stage maximum flat band-pass filter having a relative frequency band width w is considered, the following relation is required.

$$k = \frac{w}{\sqrt{2}},\ Q_{e1} = Q_{e2} = \frac{\sqrt{2}}{w} \tag{16}$$

On the other hand, when the relation expressed by the equation (15) is applied on the equation (1), the following relation is obtained.

$$k = 2\left|\frac{V_o - V_e}{V_o + V_e}\right| \tag{17}$$

So that, the following relation is obtained by substituting the equation (16) for this equation (17).

$$\left.\begin{aligned} w &= 2\sqrt{2}\left|\frac{V_o - V_e}{V_o + V_e}\right| = \sqrt{2}\ \frac{|V_o - V_e|}{\widetilde{V}} \\ &\text{where } \widetilde{V} = \frac{V_o + V_e}{2} \end{aligned}\right\} \tag{18}$$

For example, in the phase velocity property as shown in FIG. 18, the following results are obtained.

When S=1 mm, $V_e$=0.1045, $V_o$=0.113

So that, the relative frequency band width w becomes as follows.

$$w = \frac{0.0139}{0.2165} \times 2\sqrt{2} = 0.1816$$

When $S = 2$ mm,
$V_e = 0.1045$, $V_o = 0.113$

So that, the relative frequency band width w becomes as follows.

$$w = \frac{0.0085}{0.2175} \times 2\sqrt{2} = 0.111$$

When $S = 3$ mm,
$V_e = 0.1083$, $V_o = 0.1138$

So that, the relative frequency band width w becomes as follows.

$$w = \frac{0.0055}{0.222} \times 2\sqrt{2} = 0.07$$

When $S = 4$ mm,
$V_e = 0.1208$, $V_o = 0.1252$

So that, the relative frequency band width w becomes as follows.

$$w = \frac{0.0044}{0.246} \times 2\sqrt{2} = 0.0506$$

As described above, according to the coupling structure as shown in FIG. 16, the relative frequency band width substantially from 5% to 18% can be attained.

Figure 19A:
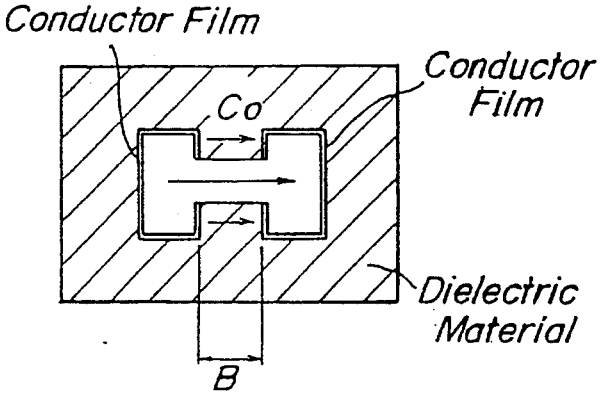
FIGS. 19A and 19B are cross-sectional views showing a simplified coupling structure according to the present invention.

Next, to clarify the physical meaning of the coupling structure as shown in FIG. 15B, a further simplified coupling structure as shown in FIG. 19A will be investigated hereinafter.

Figure 19B:
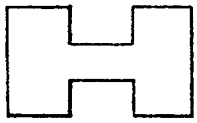

Two air holes shaped as shown in FIG. 19B are formed within a dielectric medium block and metal films are applied on portions of the inner walls of those air holes which are indicated by thick black lines in FIG. 19A. As a result, a capacitor is formed between metal films in a region B as shown in FIG. 19A, so that, the capacity in the odd mode is increased, so as to realize odd mode operation. Accordingly, the relative frequency band width can be further decreased.

Figure 20A:
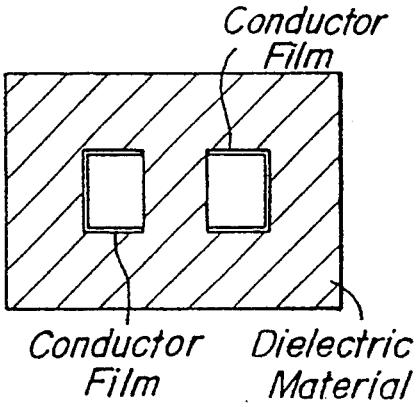
FIGS. 20A to 20C are cross-sectional views showing several other examples of coupling structure according to the present invention.
Figure 20B:
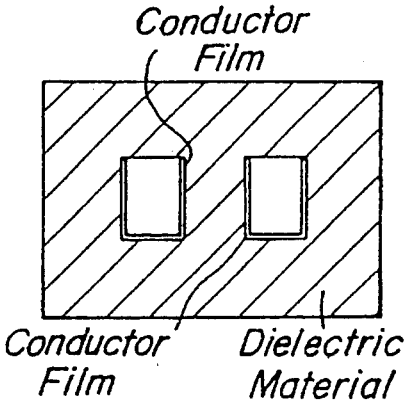
Figure 20C:
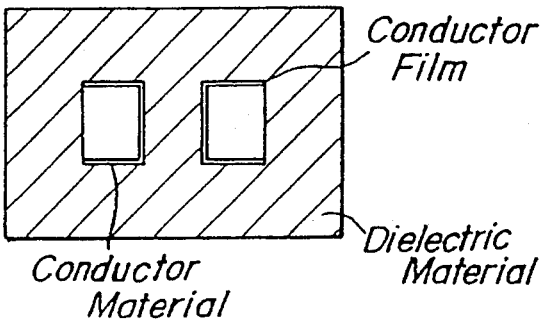

As other coupling structures, two air holes having substantially square-shape, inner walls of which (except individually different sides) are applied with metal films as shown in FIGS. 20A to 20C respectively are provided in the dielectric medium block. In these coupling structures also, as is apparent from the above investigation, according to the partial exception of the metal film applied on the inner walls of the air holes, the electric field is penetrable into the air holes, so as to realize odd mode operation.

Figure 21A:
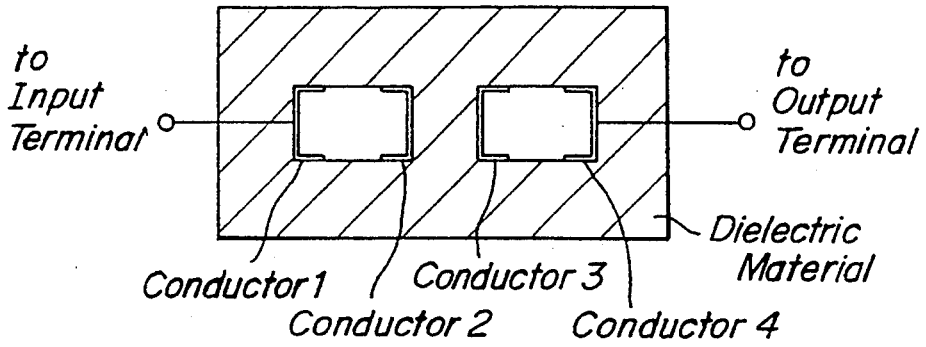
FIGS. 21A and 21B are a top view and a bottom view showing another example of the same.
Figure 21B:
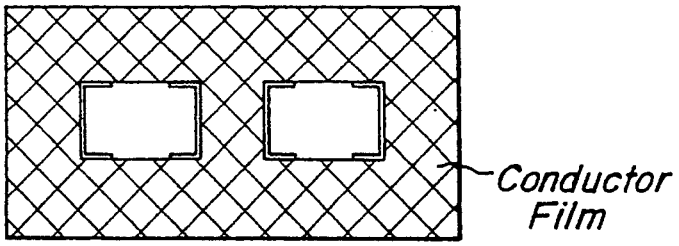
Figure 21C:
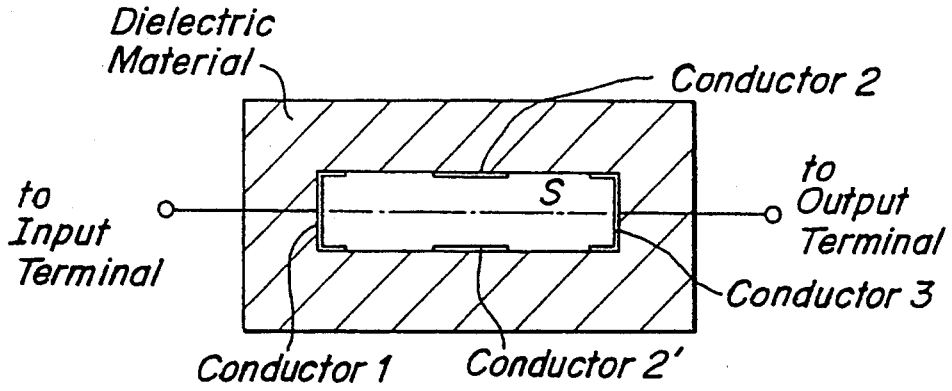
FIGS. 21C and 21D are a top view and a bottom view showing still another example of the same.

As still another coupling structure, a four stage band-pass filter can be realized by arranging two coupling structures as shown in FIG. 15A side by side as shown in FIGS. 21A and 21B. In this coupling structure, the same coupling coefficient as that in the coupling structure as shown in FIG. 15A is applied for the coupling between the conductor lines 1 and 2 or 3 and 4, while a substantially similar coupling coefficient as that in the coupling structure as shown in FIG. 20C is applied for the coupling between the conductor lines 2 and 3.

Figure 21D:
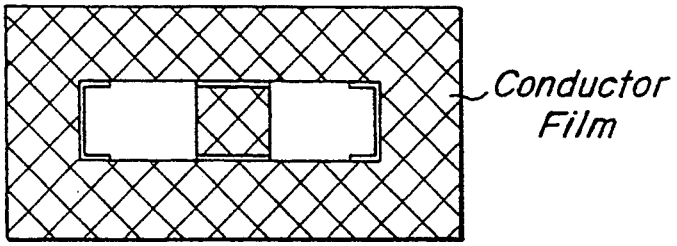

As still further another coupling structure, a three stage band-pass filter can be realized by forming a single oblong air hole within the dielectric medium block, on both end portions and a central portion of an inner wall of which metal films are applied, as shown in FIGS. 21A and 21D. In this coupling structure, conductor films 2 and 2' are mutually connected in the bottom face of the dielectric medium block and hence have the same potential with each other and are operated in a single resonant mode, because this resonator is operated in the even mode as for a symmetry plane parallel with the longer side of the oblong hole.

As is apparent from the above description in detail, the following effects can be obtained according to the present invention.

Figure 1:
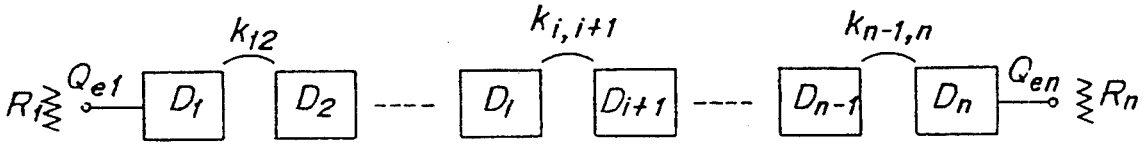
FIG. 1 is a block diagram showing an outlined arrangement of a band pass filter as described before.
Figure 2A:
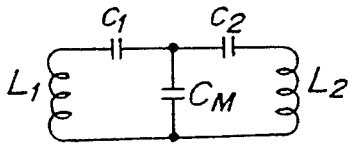
FIGS. 2A to 2D are circuit diagrams showing examples of coupling structures between resonating circuits as described before.
Figure 2B:
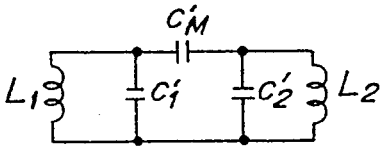
Figure 2C:
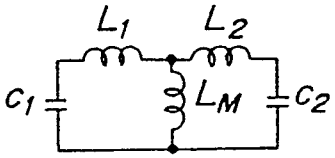
Figure 2D:
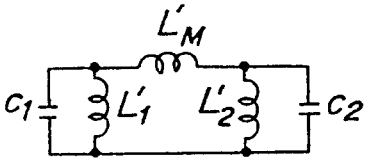
Figure 3:
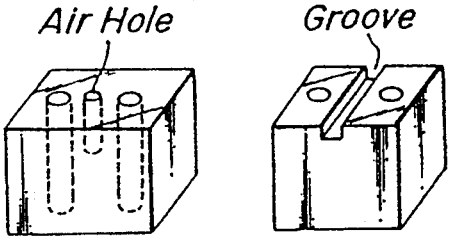
FIG 3 PRIOR ART
FIG. 3 is a perspective view showing specific structures of the same as described before.
Figure 4A:
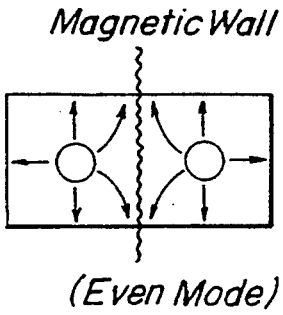
FIGS. 4A, 4B and 4C are diagrams showing operation modes and an equivalent circuit of the same as described before.
Figure 4B:
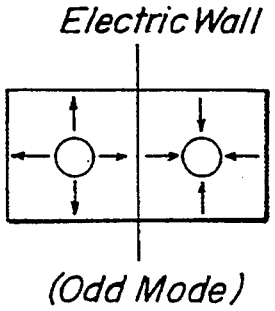
Figure 4C:
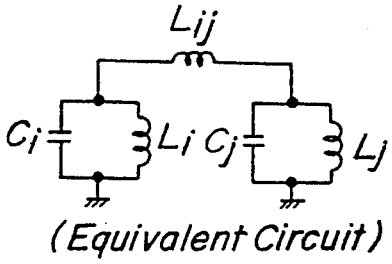
Figure 5:
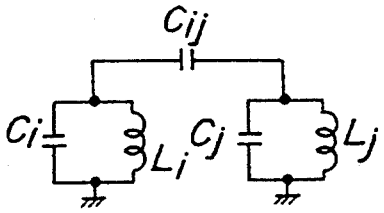
FIG. 5 is a circuit diagram showing another equivalent circuit of the same as described before.
Figure 6A:
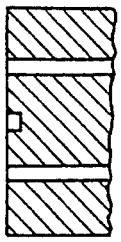
FIGS. 6A to 6D are diagrams showing side and bottom views and magnetic field distributions of the same as described before.
Figure 6B:
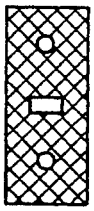
Figure 6C:
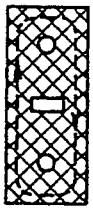
Figure 6D:
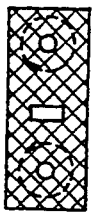
Figure 7A:
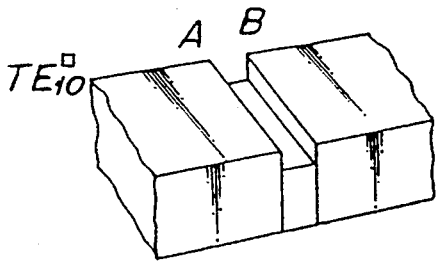
FIG 7A PRIOR ART
FIGS. 7A and 7B are a perspective view and a circuit diagram showing examples of the same respectively as described before.
Figure 7B:
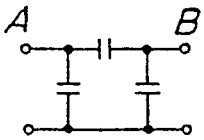
Figure 8A:
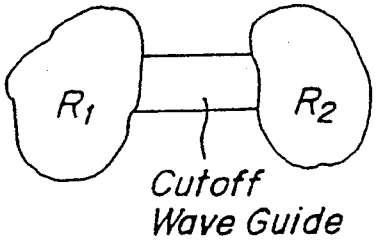
FIG 8A PRIOR ART
FIGS. 8A to 8C are diagrams showing other examples of the same respectively as described before.
Figure 8B:
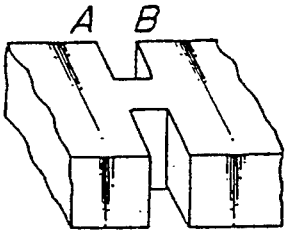
FIG 8B PRIOR ART
Figure 8C:
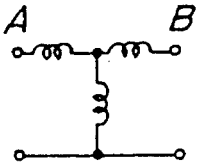
Figure 9:
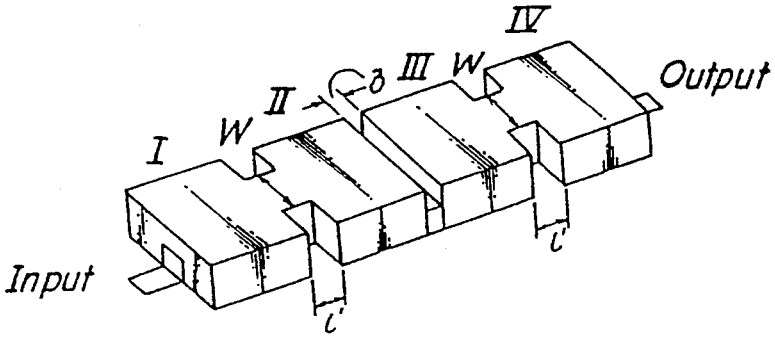
FIG 9 PRIOR ART
FIG. 9 is a perspective view showing still another example of the same as described before.
Figure 10A:
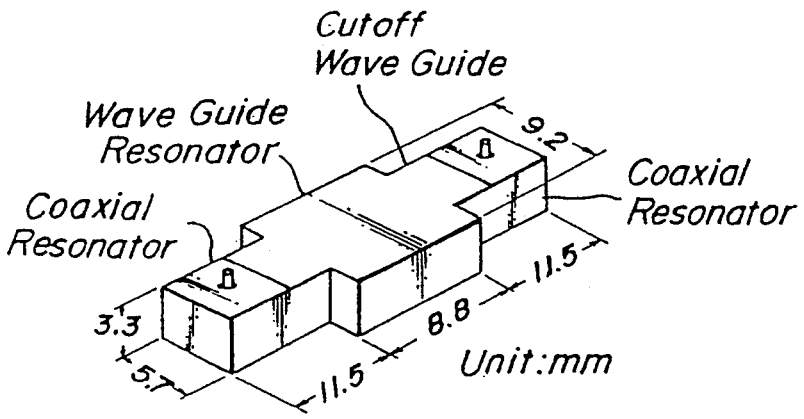
FIG 10A PRIOR ART
FIGS. 10A and 10B are a perspective view and a characteristic curve showing still another example of the same as described before.
Figure 10B:
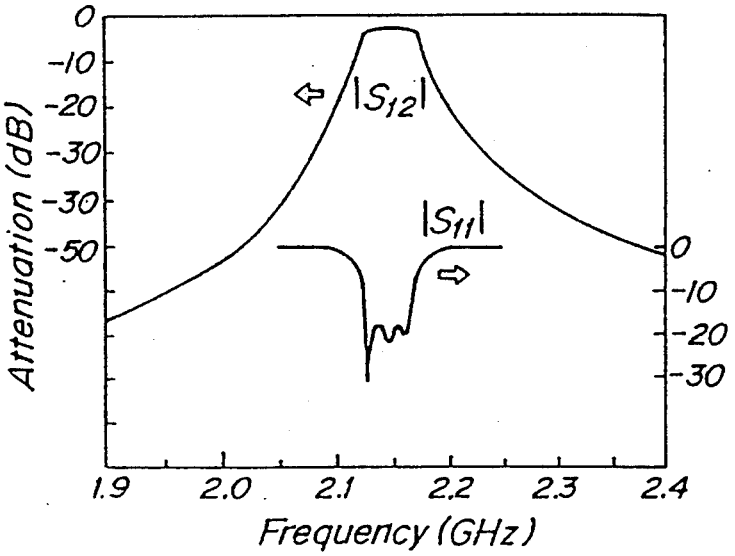
Figure 11A:
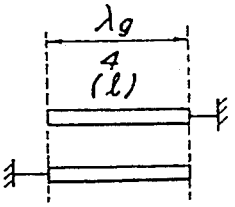
FIG. 11A to 11C are diagrams showing examples of coupled distributed lines respectively as described before.
Figure 11B:
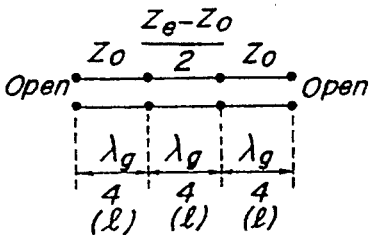
Figure 11C:
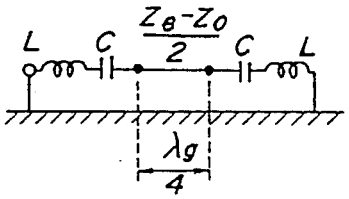
Figure 12A:
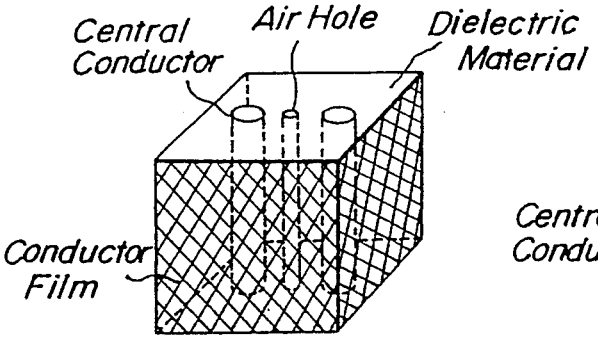
FIG 12A PRIOR ART
FIGS. 12A to 12C are diagrams showing a specific example of the same as described before.
Figure 12B:
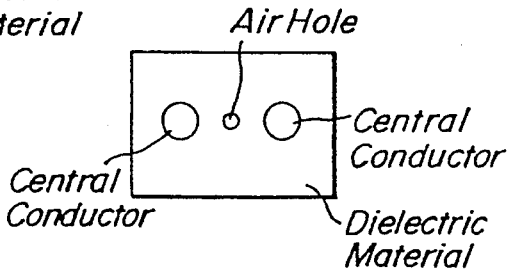
FIG 12B PRIOR ART
Figure 12C:
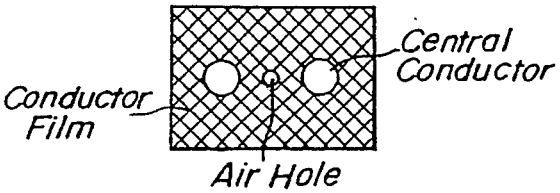
FIG 12C PRIOR ART
Figure 13A:
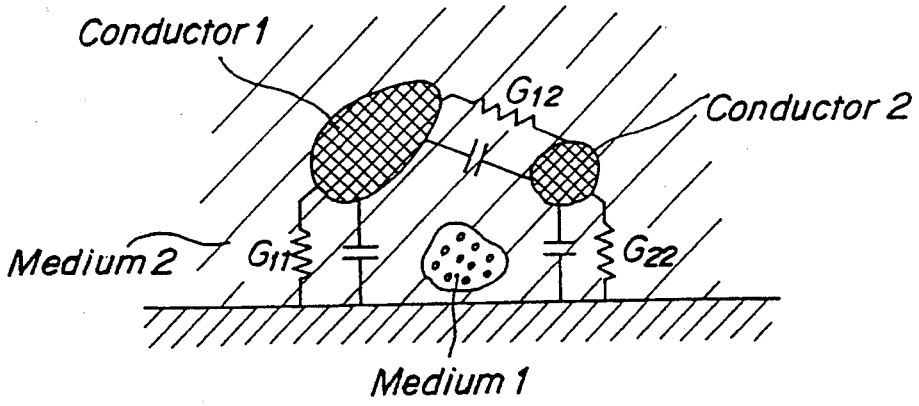
FIGS. 13A and 13B are diagrams showing another example of the same as described before.
Figure 13B:
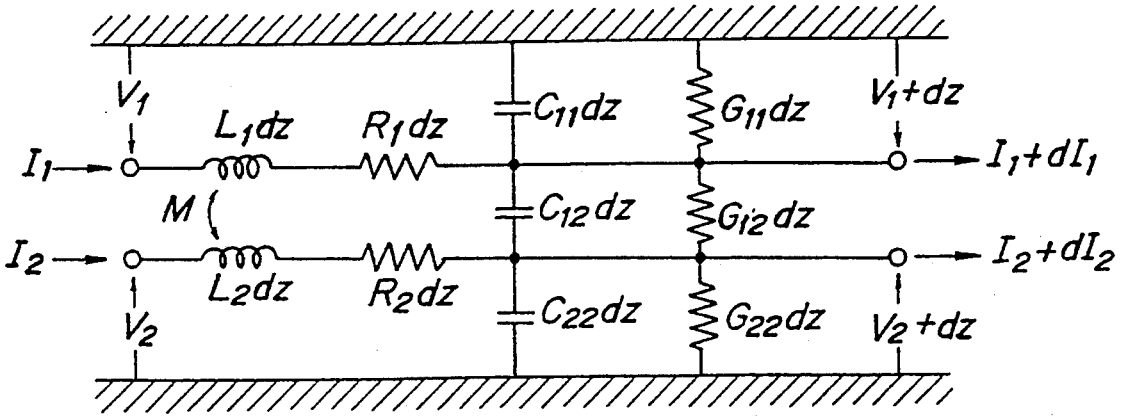
Figure 14:
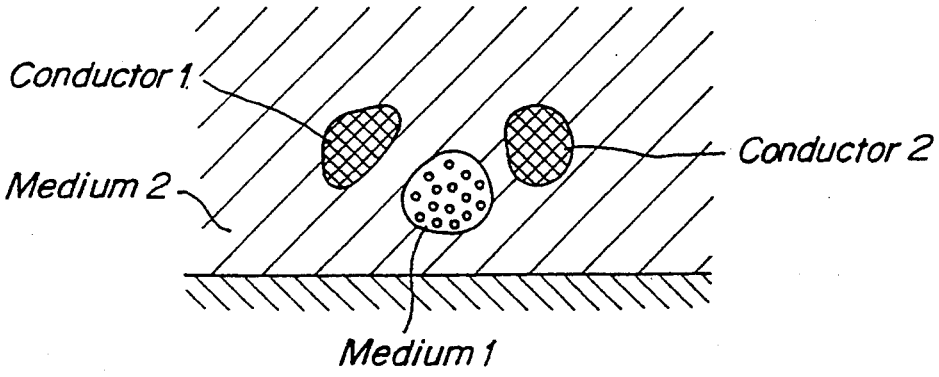
FIG. 14 is a diagram showing still another example of the same as described before.

(1) In the conventional coupling structure as shown in FIGS. 12A to 12C, three air holes including a central air hole for coupling two resonating air holes are required, so that a large-sized structure cannot help being required. However, in the coupling structure according to the present invention, even only one air hole is satisfiable, so that a small-sized coupling structure for providing the band-pass filter can be attained.

(2) Because the number of required air holes can be reduced, the high precision and the non-alignment of the resonators are readily facilitated.

What is claimed is:

1. A quasi-TEM mode dielectric filter comprising:

a dielectric material block, surrounded by a first conductor film, having a plurality of holes formed therethrough, individual ones of said plurality of holes including: a second conductor film disposed on a first portion of an inner periphery of a respective hole, and a third conductor film disposed on a second portion of an inner periphery of said respective hole, said first portion and said second portion not being in direct contact with one another, and wherein (i) said respective hole, (ii) said second conductor film and (iii) said third conductor film cooperate to define a resonator unit including uniform quasi-TEM mode lines, and wherein an electro-magnetic field coupling between said second and third conductor films passes through each of said individual holes.

2. A quasi-TEM mode dielectric filter as claimed in claim 1, wherein individual ones of said uniform quasi-TEM mode lines cooperate to define a multi-stage band-pass dielectric filter.

* * * * *